US009990908B2

(12) United States Patent
Badalament

(10) Patent No.: US 9,990,908 B2
(45) Date of Patent: Jun. 5, 2018

(54) PERCUSSION INSTRUMENT STRAINER AND TUNING SYSTEM

(71) Applicant: Stephen F. Badalament, Bloomfield Hils, MI (US)

(72) Inventor: Stephen F. Badalament, Bloomfield Hils, MI (US)

( * ) Notice: Subject to any disclaimer, the term of this patent is extended or adjusted under 35 U.S.C. 154(b) by 0 days. days.

(21) Appl. No.: 15/583,365

(22) Filed: May 1, 2017

(65) Prior Publication Data

US 2017/0365242 A1 Dec. 21, 2017

Related U.S. Application Data

(60) Provisional application No. 62/330,519, filed on May 2, 2016.

(51) Int. Cl.
*G10D 13/02* (2006.01)

(52) U.S. Cl.
CPC ..... *G10D 13/025* (2013.01); *G10D 13/023* (2013.01); *G10D 13/027* (2013.01); *G10D 13/028* (2013.01)

(58) Field of Classification Search
CPC ..... G10D 13/023; G10D 13/025
See application file for complete search history.

(56) References Cited

U.S. PATENT DOCUMENTS

2006/0249006 A1* 11/2006 Whittington ..... G10D 13/022 84/415
2009/0266221 A1* 10/2009 Cleland ..... G10D 13/025 84/417

* cited by examiner

*Primary Examiner* — Kimberly Lockett

(57) ABSTRACT

A strainer system includes an adjustable slide assembly that can be used as a strainer side assembly or a butt side slide assembly for tensioning a snare that will not detune due to sympathetic vibrations. The strainer system may also be configured to easily control the amount of snare contact with the bearing edge on both the strainer side and the butt side of the shell body.

20 Claims, 6 Drawing Sheets

PERCUSSION INSTRUMENT STRAINER AND TUNING SYSTEM

CROSS-REFERENCE TO RELATED APPLICATIONS

This application claims the benefit of U.S. Provisional Application No. 62/330,519, filed on May 2, 2016.

TECHNICAL FIELD

The present disclosure relates generally to percussion instruments having a snare assembly, and more particularly relates to a snare strainer and tuning system for precisely tensioning the snare wires and controlling the snare wire contact with a bearing edge of the percussion instrument.

BACKGROUND

This section provides background information related to the present disclosure which is not necessarily prior art.

A percussion instrument such as a drum includes a top side or batter head seated on an upper end of a shell body with an upper hoop and a bottom side or resonant head seated on a lower end of the shell body with a lower hoop. The upper and lower hoops are secured to the shell body with upper and lower tension rods threaded into tension posts attached to the side of the shell body. The tension rods are also used to adjust the pitch and tonal character of the drum.

A drum may be provided with a snare for producing a sharp staccato sound when the head of the drum is struck. The snare includes a rattle element of wires, cables or gut strings that can be brought into contact with a head of a drum, typically the resonant head. A strainer assembly includes a strainer or snare side plate and a butt side plate secured to opposite sides of the shell body and is used to attach the snare to the drum. The snare side plate typically includes a throw-off mechanism for engaging and disengaging contact between the snare and the snare head. The snare side plate may also include a mechanism for adjusting the tension in the snare, which affects the tone of the snare.

In some set-ups, the rattle element of the snare extends over the edge of the shell body. In these set-ups, the interface between a portion of the shell body edge, also called the bearing edge, and the snare can significantly affect the tone of the snare. Conventional percussion instruments have a stationary horizontal edge, typically formed on the strainer plate and butt plate castings, which are fixed at a predetermined position, and do not permit precise set-up of the bearing edge/snare wire interface for further adjusting the pitch and tonal character of the drum.

Sympathetic vibration is a persistent issue that percussionists deal with on a regular basis. When a drum is struck multitudes of competing sympathetic vibrations are generated that will act to detune the drum heads and the strainer assembly. The tensioning mechanism in conventional designs tends to lose snare tension and thus detune as a result of the sympathetic vibrations generated when the drum is played. Accordingly, there is a need in the art for a snare strainer system configured to precisely set and maintain the tension of the snare without any significant detuning due to sympathetic vibrations.

In addition, it is desirable to provide a strainer system configured to easily control the amount of snare contact with the bearing edge of the shell body. Furthermore, other desirable features and characteristics of the present invention will become apparent from the subsequent detailed description of the invention and the appended claims, taken in conjunction with the accompanying drawings and this background of the invention.

SUMMARY

In accordance with one aspect of the present disclosure, a strainer system includes an adjustable slide assembly that can be used as a strainer side assembly or a butt side slide assembly for tensioning a snare that will not detune due to sympathetic vibrations.

In one embodiment, the adjustable slide assembly includes a slide platform having a slide rail with a channel formed therein and a bracket extending from the slide rail. A slide is supported on the slide platform and includes a body having a beam received in the slide rail channel and a pressure plate configured to secure the snare to the slide. A snare tensioner operably couples the slide to the slide platform to selectively position the slide thereon. The snare tensioner includes a tension rod having a first portion with at least one flat region formed therein and a threaded region extending to a first end of the tension rod. A second portion of the tension rod extends through an aperture formed in the slide rail bracket. A knob is disposed on a second end of the second portion of the tension rod. A collar is disposed around the tension rod and captures the slide rail bracket between the knob and the collar. An insert housing is fixed to the slide body and has a tangential slot and a longitudinal bore formed therein. The longitudinal bore includes a threaded portion receiving the threaded region of the tension rod. An elastic clip extends over the insert housing and has a detent section located in the tangential slot that extends into the longitudinal bore. The tension rod is rotatable in the insert housing to a detent position such that the detent section engages the flat region and the elastic clip resists further rotation or counter-rotation of the tension rod within the insert housing to eliminate detuning.

In another embodiment, a percussion instrument includes a drum having a shell body, a batter head seated on an upper end of the shell body with an upper hoop and a resonant head seated on a lower end of the shell body with a lower hoop. A strainer assembly includes a strainer slide assembly secured to the shell proximate the lower end, and a butt side slide assembly secured to the shell proximate the lower end and diametrically opposite the strainer slide assembly. A snare has a first end secured to the strainer slide assembly, a second end secured to the butt side slide assembly and a rattle extending between the first and second ends and in contact with the resonant head. Each of the strainer and butt side slide assemblies includes a slide platform having a slide rail with a channel formed therein and a bracket extending from the slide rail. A slide is supported on the slide platform and includes a body having a beam received in the slide rail channel and a pressure plate securing the ends of the snare to the slide. A snare tensioner operably couples the slide to the slide platform to selectively position the slide thereon. The snare tensioner includes a tension rod having a first portion with at least one flat region formed therein and a threaded region extending to a first end of the tension rod. A second portion of the tension rod extends through an aperture formed in the slide rail bracket. A knob is disposed on a second end of the second portion of the tension rod. A collar is disposed around the tension rod and captures the slide rail bracket between the knob and the collar. An insert housing is fixed to the slide body and has a tangential slot and a longitudinal bore formed therein. The longitudinal bore includes a threaded portion receiving the threaded region of the tension rod. An elastic clip extends over the insert housing and has a detent section is located in the tangential slot that extends into the longitudinal. The tension rod is rotatable in the insert housing to a detent position such that the detent section engages the flat region and the elastic clip resists further rotation or counter-rotation of the tension rod within the insert housing to eliminate detuning.

In accordance with another aspect of the present disclosure, a strainer system is provided which is configured to easily control the amount of snare contact with the bearing edge on both the strainer side and the butt side of the shell body.

In yet another embodiment, a slide assembly includes a slide platform including a slide rail having a channel formed therein and a bracket extending from the slide rail. A slide includes a body having a beam received in the slide rail channel to slideably support the slide on the slide platform. A pressure plate is configured to secure the snare to the slide. A snare tensioner operably couples the slide to the slide platform and selectively positions the slide thereon. A plate is configured to secure the slide assembly to the percussion instrument. The plate includes a base attached to the slide platform in a fixed position, wherein the slide rail is spaced apart from the base. A pair of vertical straps extends from the base, and a horizontal slide tube extends between the pair of vertical straps and is vertically positionable along the pair of vertical straps for adjusting the amount of snare contact with the bearing edge of the shell body.

BRIEF DESCRIPTION OF THE DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings. There is no intention to be limited by any principle presented in the preceding background or the following detailed description.

Figure 1:
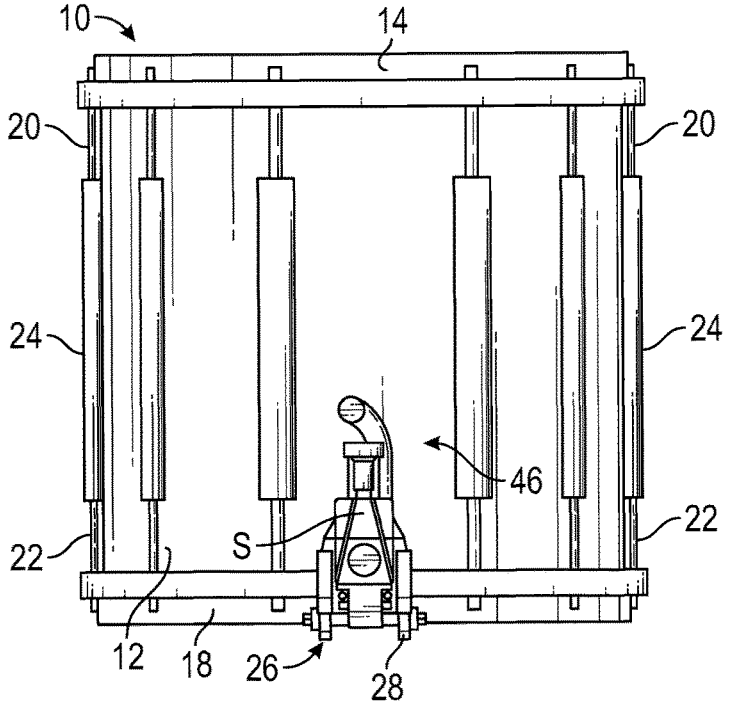
FIG. 1 is a side view of a drum with a strainer assembly according to an embodiment of the present disclosure.
Figure 2:
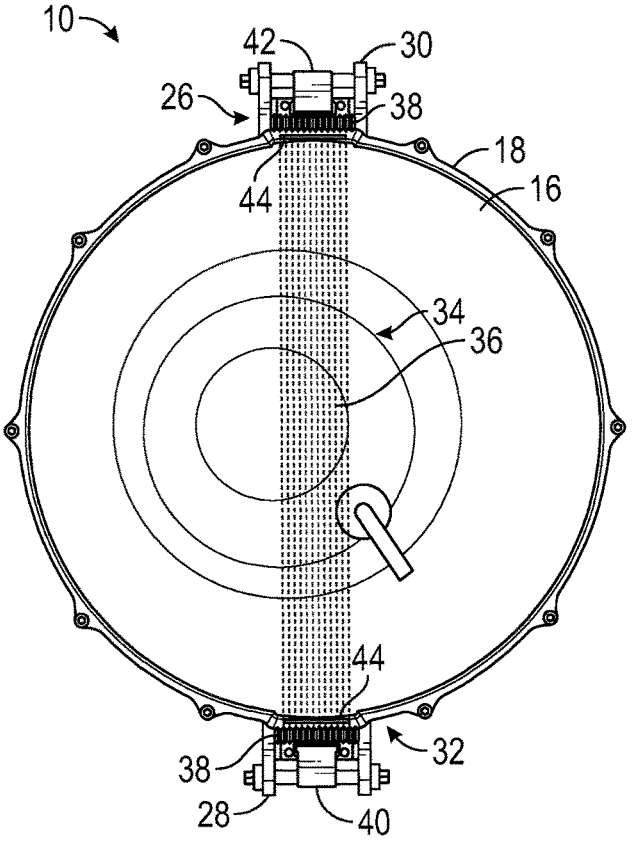
FIG. 2 is a top view of a drum including the strainer assembly shown in FIG. 1.
Figure 3:
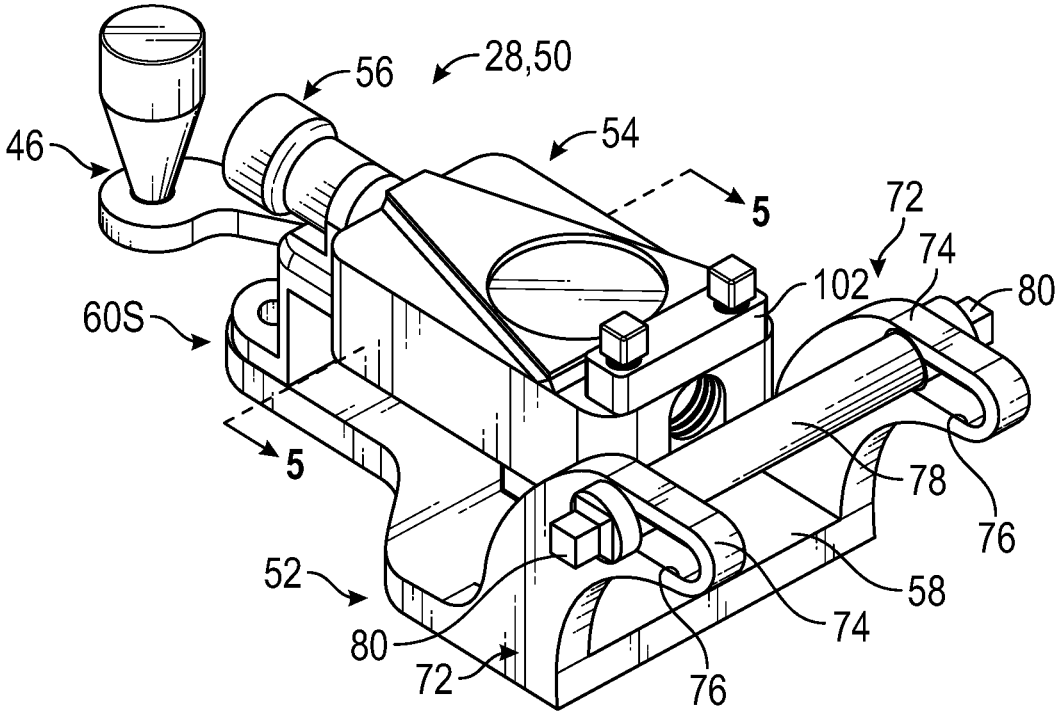
FIG. 3 is a perspective view of a strainer slide assembly.

With reference to FIGS. 1 and 2, a drum 10 includes a batter head (not shown) seated on a upper end of a shell body 12 with an upper hoop 14 and a resonant head 16 seated on a lower end of the shell body 12 with a lower hoop 18. The upper and lower hoops 14, 18 are secured to the shell body 12 with upper and lower tension rods 20, 22 threaded into tension posts 24 attached to the side of the shell body 12. The tension rods 20, 22 are also used to adjust the pitch and timbre/tone quality of the drum 10.

A strainer assembly 26 includes a strainer or snare side slide assembly 28 and a butt side slide assembly 30 secured to opposite sides of the shell body 12, which are used to attach a snare 32 to the drum 10. The snare side slide assembly 28 includes a throw-off linkage 46 for engaging and disengaging contact of the snare rattle 34 with the resonant head 16 and the snare bed 44, thus minimizing or eliminating the effects of the snare 32 on the timbre/tone quality of the drum 10. Except for the throw-off linkage 46, the snare side slide assembly 28 and the butt side slide assembly 30 are structurally and functionally similar. As such, the term slide assembly may be used herein to refer to either the snare side slide assembly 28 or the butt side slide assembly 30.

A snare 32 includes a rattle 34 having a plurality of fine coiled wires 36 (or cables, or gut strings) and a plate 38 attached at each end of the snare wires 36. A strap 40 extends from one plate 38 and is secured to the snare side slide assembly 28. A strap 42 extends from the other plate 38 and is secured to the butt side slide assembly 30. As shown in FIG. 2, the plates 38 of the rattle 34 are located outboard of the shell body 12 such that the snare wires 36 extends over the snare bed 44 formed in the bearing edge 46 of the shell body 12. The slide assemblies 28, 30 are configured to position the snare 32 into contact with the resonant head 16 for producing a sharp staccato sound when the batter head of the drum 10 is struck.

With reference now to FIGS. 3-6, the snare side slide assembly 28 will be described, and with reference to FIGS. 7-10, the butt side slide assembly 30 will be described. In this context, common elements found in the snare side slide assembly 28 and the butt side slide assembly 30 are given the same or similar reference numbers. In these figures, the snare side slide assemblies 28 and the butt side slide assembly 30 are collectively referenced as slide assembly 50. The slide assembly 50 includes a plate 52, a slide 54 and a snare tensioner 56. The plate 52 has a base 58 configured to abut the shell body 12. As shown in FIGS. 3-6, the snare side slide assembly 28 includes a slide platform 60S having two posts 62S extending from a slide rail 64S and terminating at feet 66S. As shown in FIGS. 7-10, the butt side slide assembly 30 includes a slide platform 60B having two posts 62B, extending from a slide rail 64B and terminating at feet 66B. Mounting bolts 68 extend through the feet 66S/66B, base 58 and shell body 12. A washer, lock washer and nut (collectively 70) threadably engage the mounting bolts 68 for securing the slide assembly 50 to the shell body 12.

The plate 52 includes a pair of vertical straps 72 projecting generally perpendicular from the base 58 and terminating at a distal region 74. A slot 76, which is generally parallel to a plane define by the base 58, is formed in the distal region 74. A horizontal slide tube 78 extends between the pair of vertical straps 72. A pair of shoulder bolts 80 extend through the slot 76 and are threaded into the slide tube 78. The shoulder bolts 80 are configured to slide in the slot 76 such that the slide tube 78 is vertically positionable along the pair of vertical straps 72. Once the slide tube 78 is located in a desired position relative to the snare bed 44, the shoulder bolts 80 are tightened to secure the slide tube 78 therein. As presently preferred, the slot 76 extends for a length of 0.75" for vertically adjusting the position of the slide tube 78.

With reference to FIGS. 3-6, a channel 82S is formed in the side walls of the slide rail 64S and a bearing slot 84S is formed through the major face of the slide rail 64S. An slider 86S has a slide rail bracket 88S extending therefrom. The slider 86S is received in the bearing slot 84S such that the slide rail bracket 88S extends from the major face of the slide rail 64S. The slide rail bracket 88S has an aperture 90S formed therethrough. With reference to FIGS. 7-10, a channel 82B is form in the side walls of the slide rail 64B. A slide rail bracket 88B is affixed to and extends from a major face of the slide rail 64B and has an aperture 90B formed therethrough.

Figure 5:
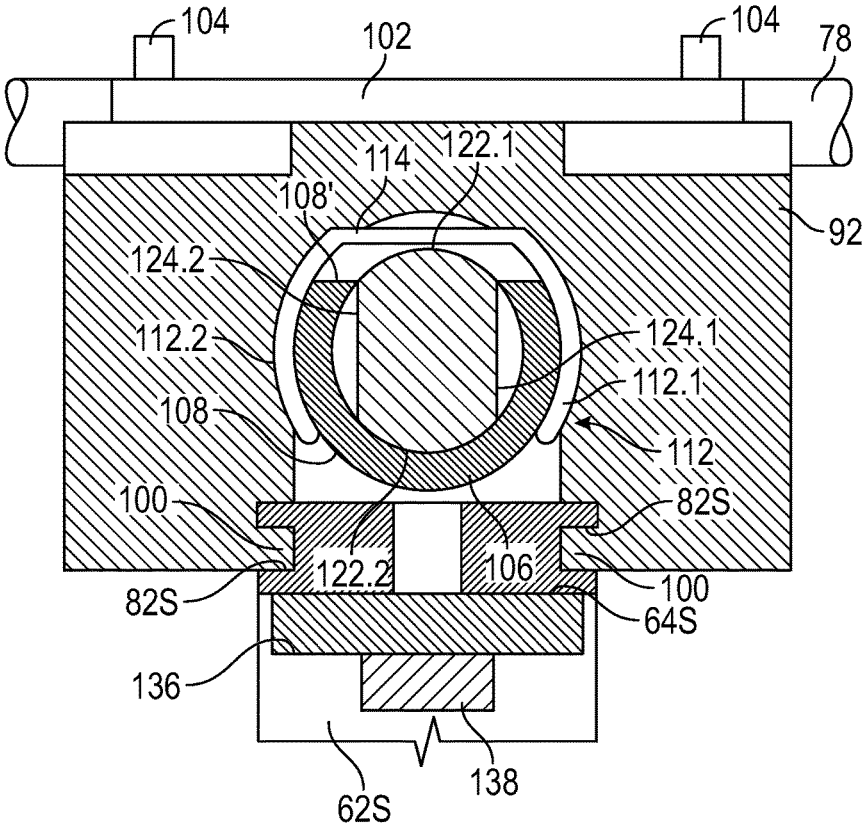
FIG. 5 is a partial cross section taken through line V-V shown in FIG. 3.
Figure 6:
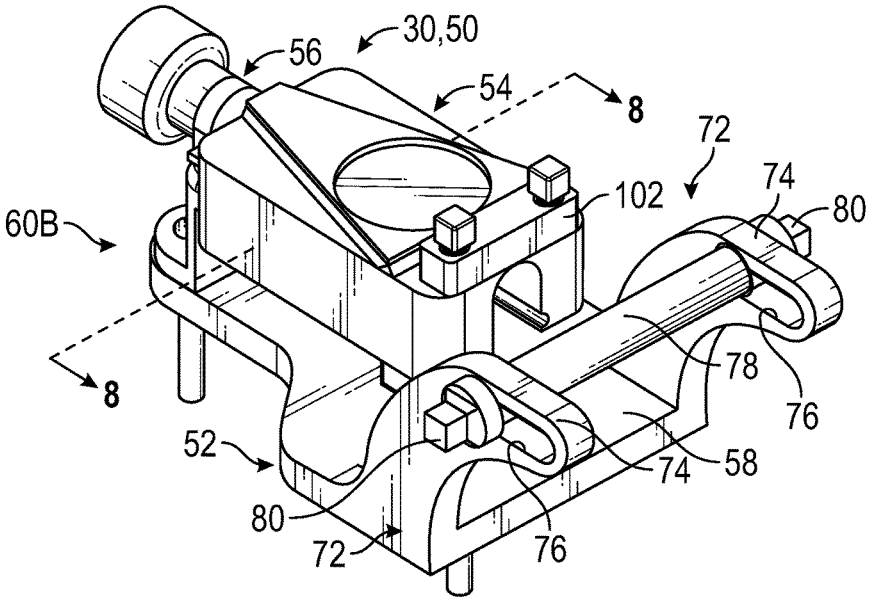
FIG. 6 is a perspective view of the butt side slide assembly.
Figure 7:
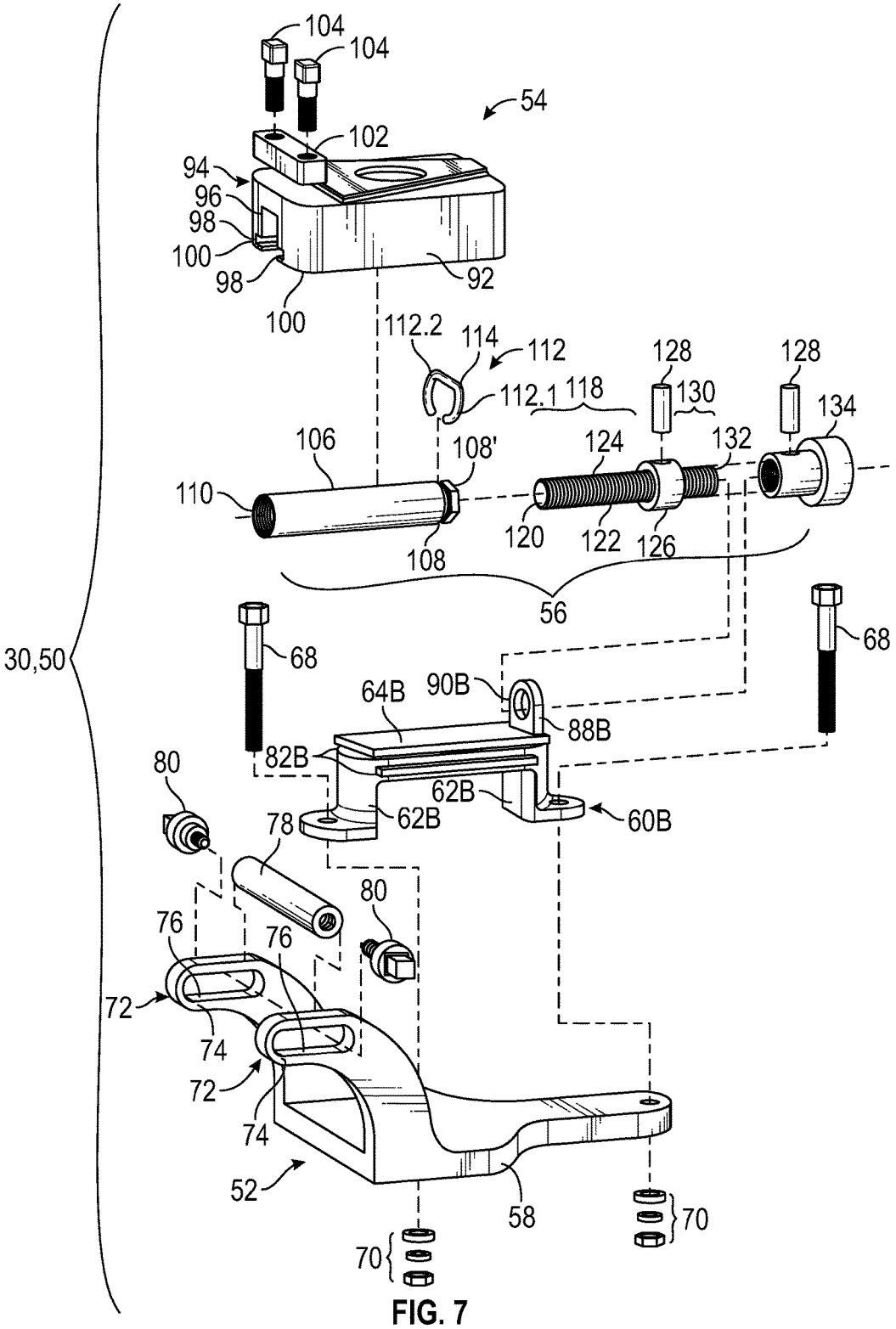
FIG. 7 is an expanded view of the butt side slide assembly shown in FIG. 6.

With reference again to FIGS. 3-10, the slide 54 includes a slide body 92 having a longitudinal groove 94, which defines an inner surface 96, formed in a bottom face of the slide 54. Channels 98 cut into opposite sides of the inner surface 96 and form a longitudinal beam 100 on each side of the longitudinal groove 94. As best seen in FIGS. 6 and 10, the beams 100 are received in the slide rail 82S/82B to slideably support the slide 54 on the slide platform 60S/60B. A pressure plate 102 is releasably secured to a top face of the slide body 92 and is releasably secured to the slide 54 with a pair of machine screws 104. The straps 40, 42 of the snare 32 are positioned between the slide body 92 and the pressure plate 102 and the machine screws 104 are tightened. In this way, the pressure plate 102 provides an attachment interface configured to secure the snare 32 to the slide 54.

Figure 8:
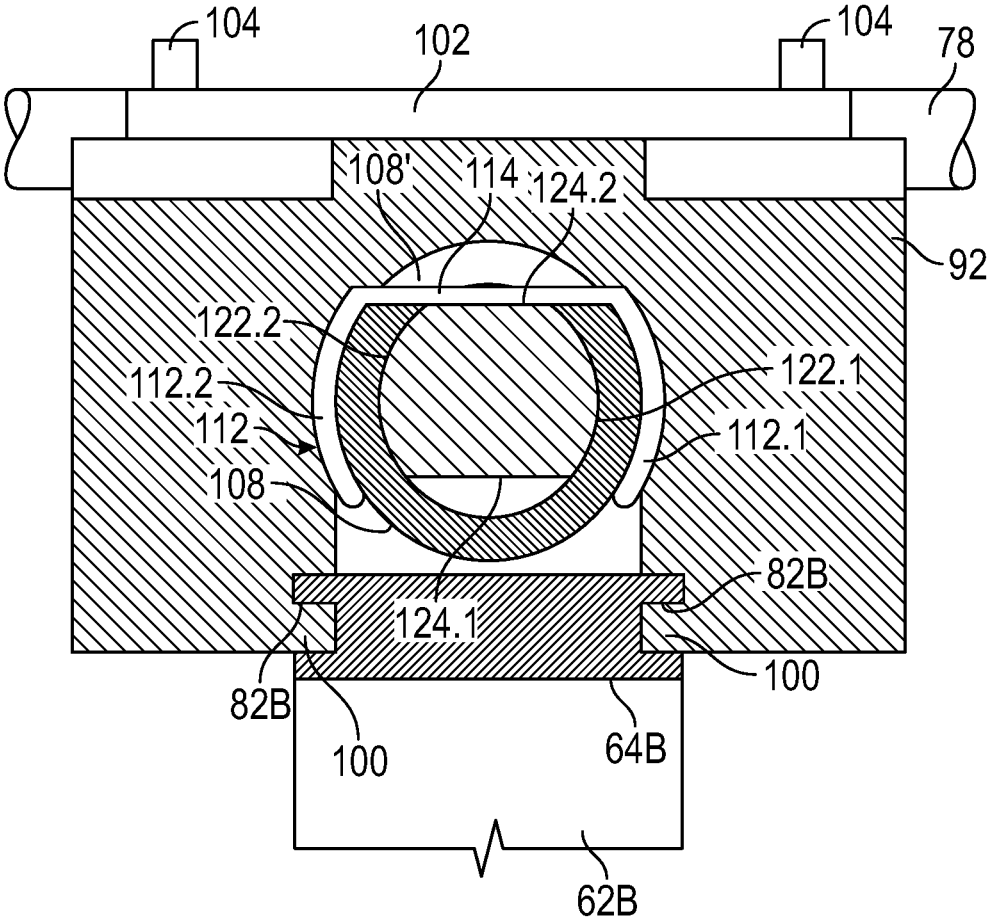
FIG. 8 is a partial cross section taken through line VIII-VIII shown in FIG. 6.

The snare tensioner 56 operably couples the slide 54 to the slide platform 60S/60B to selectively position the slide body 92 on the slide rail 60S/60B. The snare tensioner 56 includes an insert housing 106 positioned within the longitudinal groove 94 and fixed to the slide body 92. The insert housing 106 has a circumferential groove 108 and a longitudinal bore 110 formed therein. As portion of the circumferential groove 108 extends through the wall of the insert housing 106 to form a tangential slot 108'. An elastic clip 112 extends around the insert housing 106 in the circumferential groove 108. The insert housing 106 may be welded into the longitudinal groove 94 of the body 92 after the elastic clip 112 is properly positioned. A detent section 114 of the elastic clip 112 is positioned in the tangential slot 108' and extends into the longitudinal bore 110. As best seen in FIGS. 5 and 8, the middle portion of the elastic clip 112 is the detent section 114 and two legs 112.1, 112.2 wrap around the insert housing 106 and bias the detent section 114 into the tangential slot 108'. In this regard, the elastic clip 112 may be described as generally D-shaped.

The snare tensioner 56 further includes a tension rod 116 with a first portion 118 extending from a first end 120 and having threaded regions 122 with interposed flat regions 124 formed therein. A collar 126 is located onto the tension rod 116 at the end of the first portion 118 opposite the first end 120 and secured there with a roll pin 128. A second portion 130 of the tension rod 116 extending from the collar 126 to a second end 132 is inserted through the aperture 90 formed in the bracket 88S/88B. A knob 134 is secured to the second end 132 of the tension rod 116 there with a roll pin 128. It will be noted that the bracket 88S/88B is positioned between the collar 126 and the knob 134. As shown herein, two threaded regions 122.1, 122.2 (collectively 122) are formed on diametrically opposite sides (i.e. 0° and 180° as shown in FIG. 5) along the length of the first portion 118 of rod 116. Two flat regions 124.1, 124.2 (collectively 124) are formed on diametrically opposite sides (i.e. 90° and 270° as shown in FIG. 5) along the length of the first portion 118 of tension rod 116.

The tension rod 116 is rotatable in the insert housing 106 such that every half turn the detent section 114 engages a flat region 124 (i.e., a detent position). In this way, the elastic clip 112 resists further rotation or counter-rotation of the tension rod 116 within the insert housing 106 to prevent unwanted detuning of the snare 32. If a tension adjustment is desired, the tension rod 116 is rotated and the threaded region 122 elastically deforms the clip 112 and forces the detent section 114 out of the longitudinal bore 110. Continued rotation each half turn will position the tension rod 116 back into in a detent position. One skilled in the art will recognize that the number of flat sections may vary depending on the number of detent positions per rotation as required for a given specification or configuration.

As presently preferred, the tension rod 116 has a relatively large diameter (e.g., 5/16") and a relatively fine thread count (24 threads per inch) for maximum engagement between the elastic clip 112 and the tension rod 116. In addition, the insert housing 106 and the tension rod 116 are preferably made using 0/1 tool steel, which will not only maintain structural/functional tolerance but will also significantly reduce the likelihood that the tension rod 116 may become cross-threaded in the insert housing 106. As a result, these parts will have an increased dimensional stability, higher strength, and thus increased functionality for eliminating detuning of the snare 32.

Figure 4:
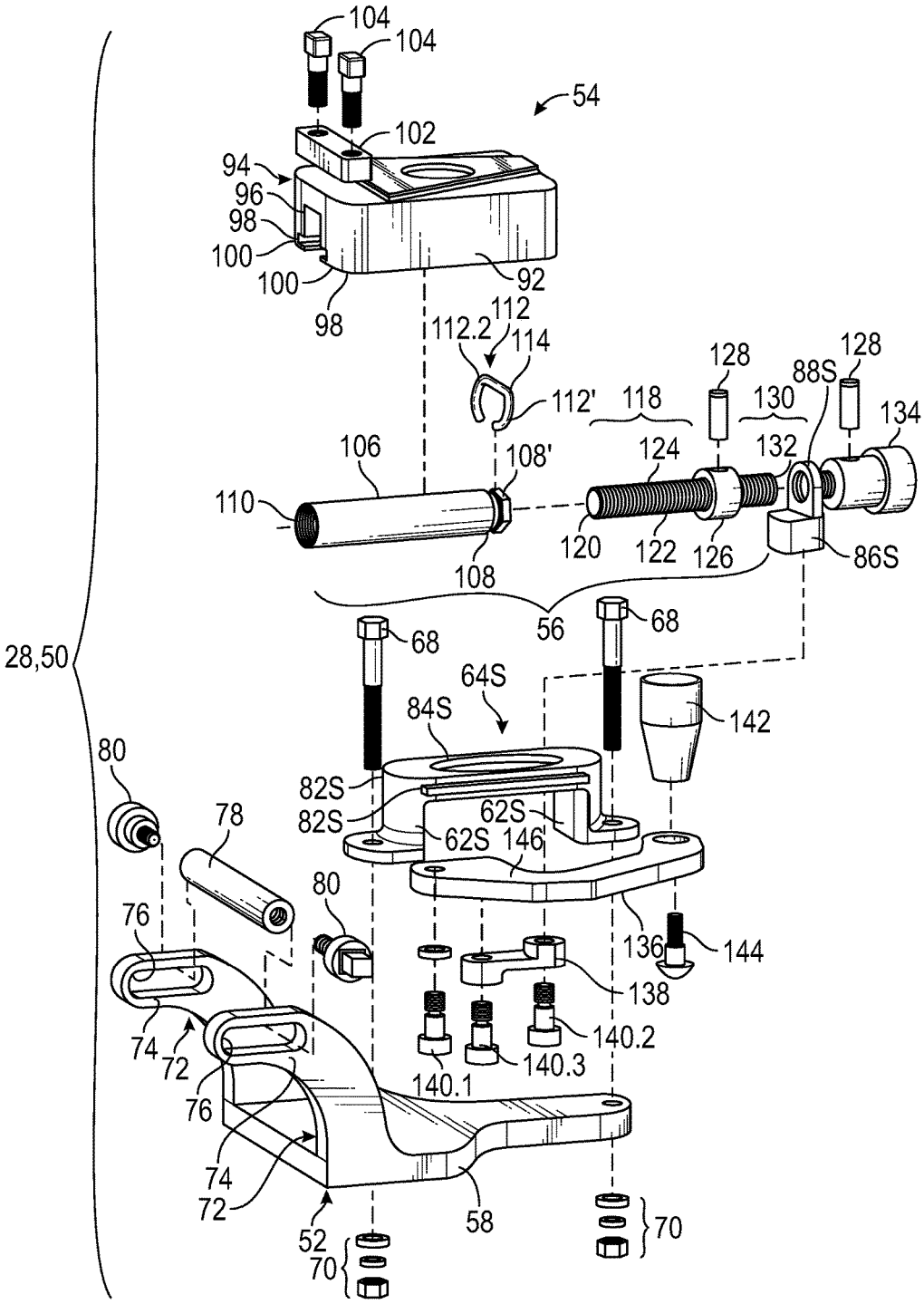
FIG. 4 is an expanded view of the strainer slide assembly shown in FIG. 3.

As mentioned above, the snare side slide assembly 28 includes a throw-off linkage 46 for engaging and disengaging contact of the rattle 34 with the resonant head 16 and the snare bed 44. With reference to FIGS. 4 and 5, the throw-out linkage 46 is configured as a sliding rocker mechanism including a throw-out lever 136 and a pivot link 138 in combination with the slider 86S supported in the bearing slot 84S. The throw-out lever 136 is a class 2 lever pivotally connected to the slide rail 64S at a point on an axis defined by the butt side slide 84S (i.e., the bearing slot axis) with a shoulder bolt 140.1. A handle 142 is attached to a second end of the throw-out lever 136 with a machine screw 144. A lobe 146 is formed at an intermediate point on the throw-out lever 136 (i.e., between the two ends). The pivot link 138 is pivotally connected at one end to the slider 86S with a shoulder bolt 140.2 and pivotally connected at the opposite end to the lobe 146 with a shoulder bolt 140.3.

In a snare-engaged position, as shown in FIG. 1, the throw-out lever 136 rests against the post 62S and the throw-out linkage 46 is in an over-center position to lock in the snare-engaged position. Specifically, the geometry of the throw-out linkage 46 is such that in the snare-engaged position, the slider 86S is near the top of the bearing slot 84S and the pivot defined by shoulder bolt 140.3 has been rotated past the bearing slot axis to place the throw-out linkage 46 (specifically the pivot defined by shoulder bolt 140.3) in the over-center position. To disengage the snare 32 (i.e., a snare-disengaged position), the throw-out lever 136 is rotated in a clockwise direction (as seen in FIG. 1), which counter-rotates the pivot link 138 and moves the slider 86S down in the bearing slot 84S. The snare-disengaged position is defined by the length of the bearing slot 84S, which sets the travel of the slider 86S in the slide rail 64S. As described above, the slide 54, which is coupled to the slider 86S through the snare tensioner 56 and the bracket 88S, is operable for enabling selective contact of the snare 32 to the resonant head 16 based on positioning of the throw-out lever 136.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A slide assembly for a snare in contact with a head of a percussion instrument comprising:

a slide platform including slide rail and a bracket extending from the slide rail, the slide rail having a channel formed therein;

a slide including a body having a beam received in the slide rail channel to slideably support the slide on the slide platform and an attachment interface configured to secure the snare to the slide; and a snare tensioner operably coupling the slide to the slide platform to selectively position the slide thereon, the snare tensioner including:

a tension rod having a first portion with at least one flat region formed therein and a threaded region extending to a first end of the tension rod and a second portion extending through an aperture formed in the bracket;

a knob disposed on a second end of the second portion of the tension rod;

a collar disposed around the tension rod and capturing the bracket between the knob and the collar;

an insert housing fixed to the slide body and having a tangential slot and a longitudinal bore formed therein, the longitudinal bore including a threaded portion receiving the threaded region of the tension rod; and an elastic clip extending over the insert housing and having a detent section located in the tangential slot and extending into the longitudinal bore for engaging the flat region;

wherein the tension rod is rotatable in the insert housing to a detent position such that the detent section engages the flat region and the elastic clip resists further rotation or counter-rotation of the tension rod within the insert housing.

2. The slide assembly of claim 1, wherein the at least one flat region is interposed with the threaded region.

3. The slide assembly of claim 1, wherein the tension rod comprises a first flat region and a second flat region diametrically opposite the first flat region.

4. The slide assembly of claim 3, wherein the first and second flat regions are interposed with the threaded region.

5. The slide assembly of claim 1, wherein the insert housing is disposed within a longitudinal groove formed in the slide body.

6. The slide assembly of claim 1, further comprising a throw-out linkage operably coupling the slide rail bracket to the slide platform for selectively positioning the slide on the slide rail.

7. The slide assembly of claim 6, wherein the throw-out linkage comprises:

a slider extending from the bracket and received in a bearing slot formed in the slide rail such that the slider and the bracket are positionable with the bearing slot;

a throw-out lever pivotally connected to the slide platform; and a pivot link having a first end pivotally connected to the slider and a second end pivotally connected to the throw-out lever.

8. The slide assembly of claim 1, further comprising a plate having a base attached to the slide platform in a fixed position, wherein the slide rail is spaced apart from the base and the plate is configured to secure the slide assembly to the percussion instrument.

9. The slide assembly of claim 8, wherein the plate further comprises a pair of vertical straps extending from the base, and a horizontal slide tube extending between the pair of vertical straps.

10. The slide assembly of claim 9, wherein the horizontal slide tube is vertically positionable along the pair of vertical straps.

11. The slide assembly of claim 10, wherein the horizontal slide tube further comprises a pair of locking bolts extending through a slot formed in each of the pair of vertical straps.

12. A slide assembly for a snare in contact with a head of a percussion instrument comprising:

a slide platform including a slide rail and a bracket extending from the slide rail, the slide rail having a channel formed therein;

a slide including a body having a beam received in the slide rail channel to slideably support the slide on the slide platform and an attachment interface configured to secure the snare to the slide; and a snare tensioner operably coupling the slide to the slide platform to selectively position the slide thereon;

a plate configured to secure the slide assembly to the percussion instrument, the plate comprising:

a base attached to the slide platform in a fixed position, wherein the slide rail is spaced apart from the base;

a pair of vertical straps extending from the base; and a horizontal slide tube extending between the pair of vertical straps and vertically positionable along the pair of vertical straps.

13. The slide assembly of claim 12, wherein the horizontal slide tube further comprises a pair of locking bolts extending through a slot formed in each of the pair of vertical straps.

14. The tensioner mechanism of claim 12, wherein the snare tensioner comprises:

a tension rod having a first portion with a threaded region extending to a first end of the tension rod, a first flat region, and a second flat region diametrically opposite the first flat region formed in the threaded region; and a second portion extending through an aperture formed in the bracket;

a knob disposed on a second end of the second portion of the tension rod;

a collar disposed around the tension rod and capturing the bracket between the knob and the collar;

an insert housing disposed within and fixed to the slide body, the insert housing having a tangential slot and a longitudinal bore including a threaded portion receiving the threaded region of the tension rod; and an elastic clip extending over the insert housing and having a detent section located in the tangential slot and extending into the longitudinal bore for engaging the flat region;

wherein the tension rod is rotatable in the insert housing to a detent position such that the detent section engages the flat region and the elastic clip resists further rotation or counter-rotation of the tension rod within the insert housing.

15. The slide assembly of claim 14, further comprising a throw-out linkage operably coupling the slide rail bracket to the slide platform for selectively positioning the glide on the slide rail, the throw-out linkage including:

a slider extending from the bracket and received in a bearing slot formed in the slide rail such that the bracket is positionable with the bearing slot;

a throw-out lever pivotally connected to the slide platform; and a pivot link having a first end pivotally connected to the slider and a second end pivotally connected to the throw-out lever.

16. A percussion instrument comprising:

a drum having a shell body, a batter head seated on an upper end of the shell body with an upper hoop and a resonant head seated on a lower end of the shell body with a lower hoop;

a strainer assembly including a first slide assembly secured to the shell proximate the lower end, and a second slide assembly secured to the shell proximate the lower end and diametrically opposite the first slide assembly;

a snare having a first end secured to the first slide assembly, a second end secured to the second slide assembly and a rattle extending between the first and second ends and in contact with the resonant head;

wherein each of the slide assembly comprises:

a plate secured to the shell body;

a slide platform secured to the plate in a fixed position, the slide platform including a slide rail spaced from the plate and a bracket extending from the slide rail, the slide rail having a channel formed therein;

a slide including a body having a beam received in the slide rail channel to slideably support the slide on the slide platform and a pressure plate releasably secured to the body, wherein the pressure plate on the first slide assembly secures the first end of the snare and the pressure plate on the second slide assembly secures the second end of the snare;

a snare tensioner operably coupling the slide to the slide platform to selectively position the slide thereon, the snare tensioner including:

a tension rod including a first portion having a threaded region extending to a first end of the tension rod, at least one flat region interposed with the threaded region, and a second portion extending through an aperture formed in the bracket;

a knob disposed on a second end of the second portion of the tension rod;

a collar disposed around the tension rod and capturing the bracket between the knob and the collar;

an insert housing disposed within and fixed to the slide body, the insert housing having a tangential slot and a longitudinal bore including a threaded portion receiving the threaded region of the tension rod; and an elastic clip extending over the insert housing and having a detent section located in the tangential slot and extending into the longitudinal bore for engaging the flat region;

wherein the tension rod is rotatable in the insert housing to a detent position such that the detent section engages the flat region and the elastic clip resists further rotation or counter-rotation of the tension rod within the insert housing.

17. The percussion instrument of claim 16, wherein the tension rod comprises a first flat region and a second flat region diametrically opposite the first flat region.

18. The percussion instrument of claim 16, wherein the slide assembly further comprises a throw-out linkage operably coupling the slide rail bracket to the slide platform to position the glide on the slide rail for enabling selective contact of the snare to the head, the throw-out linkage including:

a slider extending from the bracket and received in a bearing slot formed in the slide rail such that the bracket is positionable with the bearing slot;

a throw-out lever pivotally connected to the slide platform; and a pivot link having a first end pivotally connected to the slider and a second end pivotally connected to the throw-out lever.

19. The percussion instrument of claim 16, wherein the lower end of the shell body defines a first bearing edge adjacent the first slide assembly and a second bearing edge adjacent the second slide assembly and the snare rattle extends across the first and second bearing edges, each of the slide assemblies further comprising:

a base secured to the shell body;

a pair of vertical straps extending from the base proximal the pressure plate; and a horizontal slide tube extending between the pair of vertical straps, wherein the horizontal slide tube is vertically positionable along the pair of vertical straps for adjusting the contact of the rattle on the first and second bearing edges.

20. The percussion instrument of claim 16, wherein the horizontal slide further comprises a pair of locking bolts extending through a slot formed in each of the pair of vertical straps.

* * * * *